United States Patent [19]

Burgess et al.

[11] 4,278,341

[45] Jul. 14, 1981

[54] SHEET STRIPPING APPARATUS

[75] Inventors: Francis P. Burgess, Westboro, Mass.; Raymond G. Cormier, Nashua, N.H.; Jacques Guiguizian, Haverhill, Mass.; Leo O. Lutz, Hollis, N.H.

[73] Assignee: Nashua Corporation, Nashua, N.H.

[21] Appl. No.: 55,523

[22] Filed: Jul. 9, 1979

[51] Int. Cl.[3] ..... G03G 15/00

[52] U.S. Cl. ..... 355/3 SH; 271/DIG. 2; 271/308; 355/8

[58] Field of Search ..... 355/3 SH, 3 TR, 3 R, 355/16, 8; 271/DIG. 2, 308

[56] References Cited

U.S. PATENT DOCUMENTS

| | | | |
|---|---|---|---|
| 3,578,859 | 5/1971 | Stillings | 355/3 R |
| 3,791,729 | 2/1974 | Steiner | 355/3 SH |
| 3,926,429 | 12/1975 | Satomi et al. | 271/DIG. 2 |
| 3,936,045 | 2/1976 | Ariyama | 271/DIG. 2 |
| 3,991,999 | 11/1976 | Brooke | 271/308 |
| 4,014,538 | 3/1977 | Akiyama et al. | 271/308 X |
| 4,060,320 | 11/1977 | Doi et al. | 271/308 X |
| 4,062,631 | 12/1977 | Ichikawa et al. | 271/308 X |
| 4,159,172 | 6/1979 | Tani et al. | 355/3 TR |
| 4,163,549 | 8/1979 | Ito et al. | 271/DIG. 2 |
| 4,168,902 | 9/1979 | Golz | 355/3 R |

*Primary Examiner*—R. L. Moses

*Attorney, Agent, or Firm*—Kenway & Jenney

[57] ABSTRACT

A curved blade overlays the marginal portion of a photocopier drum photosensitive surface at the transfer station to engage copy sheets and direct them to a transport assembly removing the sheets from the transfer station. The blade is pivotally mounted at one end and connected to a reciprocating actuator at the other end. It is pivoted away from its overlaying position, after the transport assembly engages the leading corner of the sheet so that the sheet can then contact the marginal portion, and back to its overlaying position after the trailing edge of the sheet has left the surface of the drum. In one embodiment the actuator is mechanically responsive to the photocopier scanner. In another embodiment, the blade is pivotable about an intermediate portion, and the actuator is operated by a solenoid energizable by a switch at the appropriate times.

14 Claims, 10 Drawing Figures

SHEET STRIPPING APPARATUS

BACKGROUND OF THE INVENTION

The invention relates generally to photocopiers employing liquid toner developer and particularly to apparatus for stripping sheets from a photosensitive drum after transfer of the developed image from the drum to the sheet.

In a photocopier employing a rotating photosensitive drum surface, the drum surface is first electrically charged. It is then exposed to a light pattern generated by a scanner passing over an original and focused on the drum, to form a latent electrostatic image on the drum surface. The latent image is developed, and the developed image is transferred to a sheet of transfer material brought into contact with the surface image. The sheet is then transported away from the surface toward an exit tray. It becomes the desired copy of the original.

The sheet brought into contact with the surface of the drum ordinarily adheres closely to it, because of the electrostatic fields created during the photocopying process and, in the case of liquid toner copiers, because of the surface tension created by the liquid toner. The sheet must be stripped off the drum, and various methods have been developed to perform this function with a minimum of disturbance to the other elements of the copying system. One method is to blow a stream of air between the copy sheet and the surface of the drum to lift the leading edge of the copy sheet so that it may be gripped and conveyed from the drum. This method has the disadvantage of potentially disturbing the toner particles adhering to the copy sheet. In another method known to the art the sheet stripping is accomplished by claws brought into engagement with the drum. This method has the disadvantage of requiring the claws to be in contact with the drum surface, so the drum surface may become worn or damaged.

Another method, described more fully in U.S. Pat. No. 3,936,045, provides for stripping members in strip or string form in which the strip or string is pressed against an edge of the drum photosensitive surface. When the copy sheet is brought to the drum, an edge of the copy sheet slides along the member. The member includes a forward portion increasingly spaced away from the drum surface to guide a portion of the leading edge of the copy sheet to engagement by a strip-off device. A disadvantage of this approach is that an entire edge of the copy sheet is kept from contact with the drum surface and is therefore unavailable for copying. The pressure of the member against the drum photosensitive surface also may wear or damage the surface.

It is a principal object of this invention to provide a sheet stripping apparatus that minimizes interference with the photocopying process and reduces potential damage and wear to portions of the photosensitive surface. It is another important object of the invention to provide a sheet stripping apparatus that maximizes the amount of transfer sheet surface available for copying. A further object of the invention is to provide a sheet stripping apparatus that is reliable, durable, and substantially maintainance free.

SUMMARY OF THE INVENTION

The invention relates to a copying apparatus with a rotating drum having a reusable photosensitive surface. A scanner scans the original to be copied to produce a latent electrostatic image on the drum surface, which is then developed. The developed image is transferred to a transfer material at a transfer station where a sheet is conveyed to the drum surface, stripped from the surface, and transported away.

The sheet stripping apparatus of the invention features a movable guide member with a sheet contacting portion movable between a first position in which it overlays a marginal portion of the drum surface, for engaging a corner of a leading edge of a conveyed sheet of transfer material and guiding it to a sheet transporter, and a second position in which the guide portion is removed from its overlaying position so that the sheet can contact the drum surface marginal portion, for full side edge-to-edge contact between the sheet and surface.

In preferred embodiments of the invention, the guide member is a blade curved to conform to the drum surface and pivotally mounted to the copying apparatus at one end and connected at the other end to an actuator for pivoting the blade to its second position after the sheet transporter has engaged at least a leading corner of the sheet and for returning the blade to its first position after the trailing edge of the sheet has left the drum surface. In one embodiment, the actuator is mechanically responsive to the scanner. In another, the actuator is operated by a solenoid energized by a switching circuit at the appropriate times.

BRIEF DESCRIPTION OF THE DRAWING

Other objects, features and advantages of the invention will appear from the following description of particular preferred embodiments and the drawings, in which.

DESCRIPTION OF PREFERRED EMBODIMENTS

Figure 1:
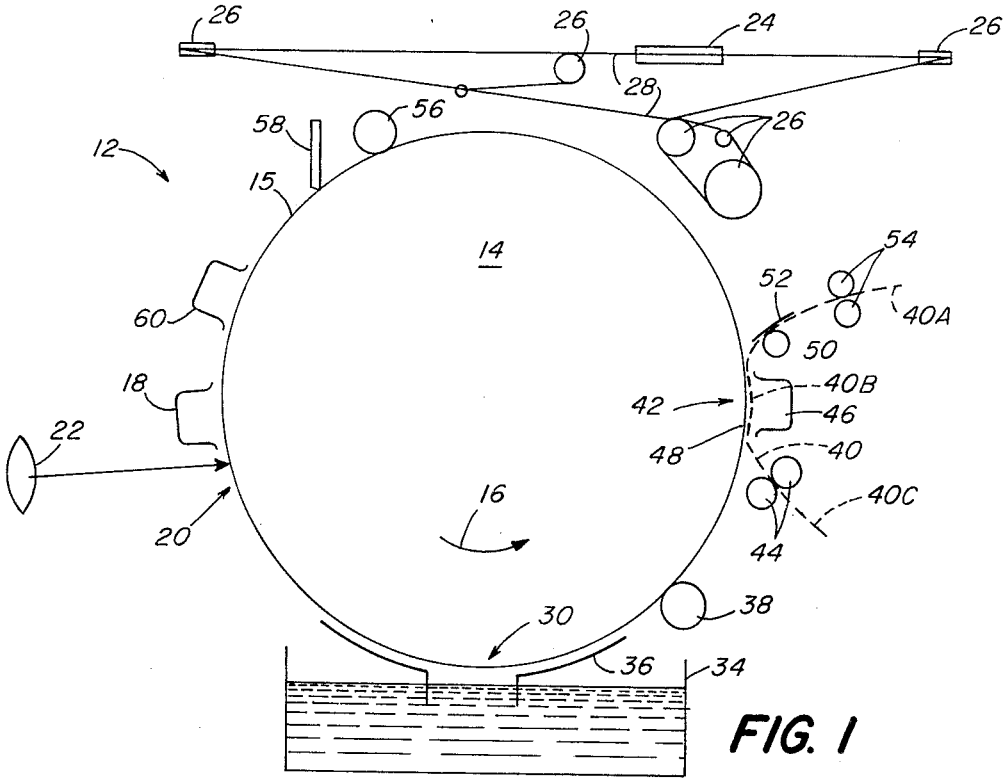
FIG. 1 is a schematic front elevation view of a photocopier in which the present invention is incorporated.

Referring to FIG. 1, there is shown a photocopier 12 in which the present invention can be employed, having a photosensitive drum 14, preferably one having a surface 15 of a photosensitive selenium layer deposited on an aluminum substrate, rotating in the counterclockwise direction as indicated by the arrow 16. A charge corona 18 charges the drum 14 to about +1000 volts D.C. The charged drum 14 is exposed to an image at an exposure station 20 transmitted to the drum through a lens 22. In the illustrated embodiment the lens 22 receives the image through an arrangement of mirrors, not shown, from a scanner 24 operated by an arrangement of pulleys 26 and cables 28.

The image is focused on the drum photosensitive surface 15 and thereupon the charge on the drum surface forms an electrostatic latent image comprising a pattern of electrical charges. The electrostatic latent image on the drum surface is brought to a development station 30 where a liquid developer 32 having a negatively charged toner contacts the electrostatic image to develop the image. The development station 30 includes a developer tank 34 and a development electrode 36. Developer 32 is introduced between the development electrode and the drum surface 15 to develop the electrostatic image. The drum surface 15, now wetted and carrying the developed image, travels past a metering roll 38 which controls and limits the thickness of the liquid developer on the drum surface.

A copy material, which is preferably a sheet 40, is fed to the drum surface 15 at a transfer station 42. The sheet 40 is conveyed to the surface by sheet registration rollers 44. There, the sheet contacts the drum surface. A positive charge from a transfer corona 46 is applied to the back side of the copy material sheet 40, causing the transfer of toner particles from the developed image on the drum's surface 15 to the copy sheet 40. The sheet 40 is stripped off the drum surface by a pick-off blade 48 that directs the copy sheet 40 to a feed-away roller 50 and paper guide 52. The sheet is fed along a path to other rollers 54 that transport the sheet to the exterior receiving tray (not shown) of the photocopier 12.

After transfer, there remains on the drum surface 15 a residue of liquid toner that is removed by a surface contacting cleaning roller 56 and a cleaning blade 58. Finally, the drum surface is electrically neutralized prior to the next charging step by a high voltage A.C. neutralizing charge from a discharge corona 60.

When the sheet 40 of transfer material, usually paper, is brought to the transfer station 42, the sheet contacts the drum surface 15 in successive portions. Referring to FIG. 1, for example, it can be seen that a leading portion 40A of the sheet is between rollers 54 for transport away from the drum surface. An intermediate portion 40B of the sheet is in contact with the drum surface 15 at the transfer station 42, where image transfer occurs. A trailing portion 40C of the sheet is being conveyed to the transfer station 42.

Figure 3:
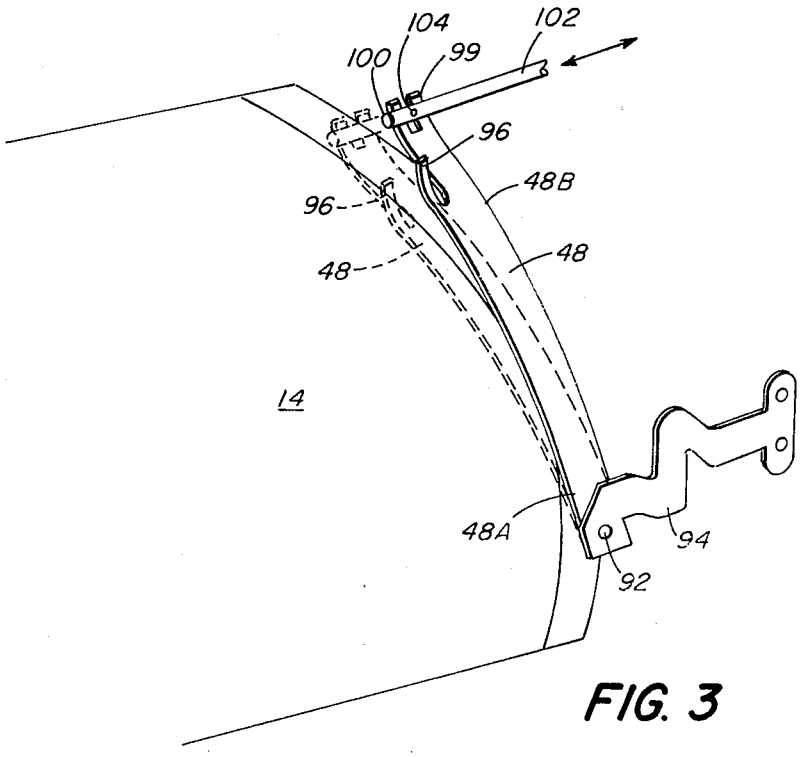
FIG. 3 is a perspective view of the drum and a pivotable blade portion of the sheet stripping apparatus shown in FIG. 2.
Figure 2:
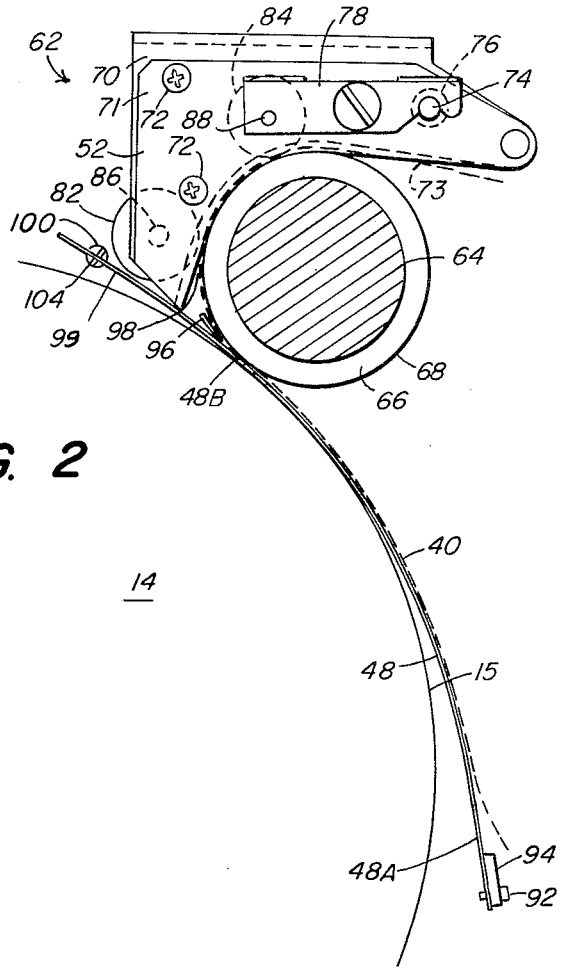
FIG. 2 is an elevation view of the drum and sheet stripping apparatus according to a first embodiment of the invention.
Figure 4:
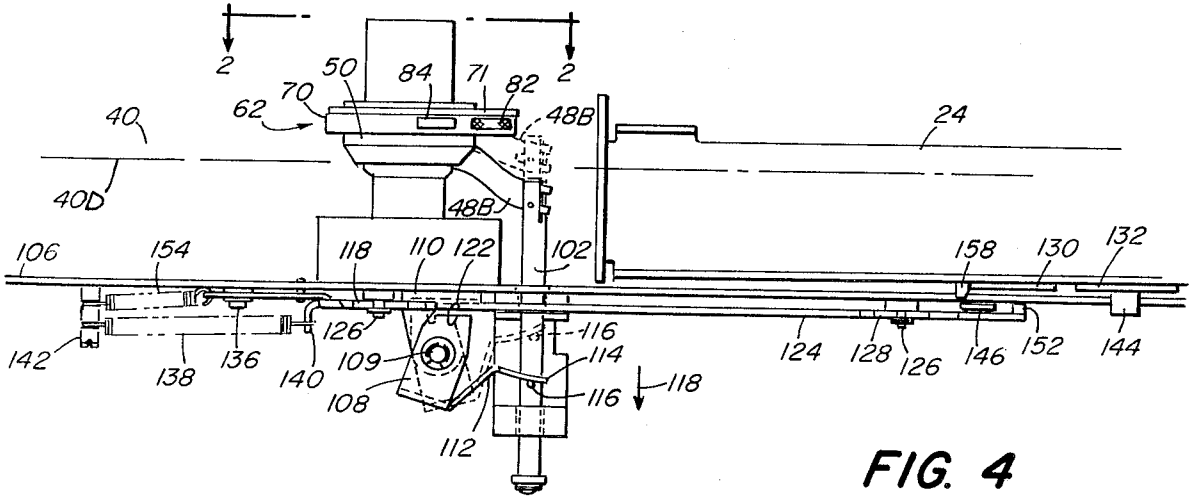
FIG. 4 is a plan view of the sheet stripping apparatus shown in FIG. 2, showing particularly the linkage between the scanner of the photocopier and the apparatus shown in FIG. 2.

FIGS. 2, 3, and 4 show in greater detail drum 14, the pickoff blade 48, and, just above the pick-off blade, a sheet transport assembly 62 that includes the feed-away roller 50 and the paper guide 52 of FIG. 1. The feed-away roller 50 is mounted for free rotation on a shaft 64. Shaft 64 in turn is positionally fixed adjacent the drum by the paper handling portion of the photocopier frame. The roller preferably has a metal body 66 with a surface layer 68 of rubber.

The rest of the illustrated sheet transport assembly 62 is supported adjacent the roller 50 by the paper handling frame section and includes a vertically oriented base plate 70 with a shim plate 71 secured to it by screws 72. The shim plate, for example a mylar material, has a lower edge 73 shaped to conform to a portion of the circumference of the feed-away roller 50 so that a paper sheet 40 carried around the roller is guided by the edge. The base plate 70 is pivotally secured to a stud 74 mounted on the photocopier frame. Plate 70 carries a cylindrical collar 76 projecting from the back of the base plate which mates with stud 74. A locking latch 78 is pivotally mounted on the face of the assembly to engage a groove in the stud 74 to lock the assembly into position. The assembly further has a lower knurled wheel 82 and a upper knurled wheel 84 secured to and mounted for free rotation on shafts 86, 88 respectively. Shafts 86, 88 project rearwardly from the base plate 70. When the assembly 70 is locked into position, the knurled wheels 82, 84 ride along the feed-away roller 50 to grip and transport the image carrying "wet" side of sheets 40 around the roller 50, guided by the edge 73 of the shim plate 71.

The drum surface selenium photosensitive layer 15 extends over an aluminum substrate 90. Typically an edge of the substrate 90 is not covered by selenium. The pick-off blade 48 is located below the transport assembly 62 adjacent the marginal edge of the drum surface 15, as shown in FIG. 3. The blade 48 is curved and conforms generally to the circumference of the drum 14. The illustrated blade is pivotally mounted for quick release at its lower end 48A by a spring loaded stud member 92 extending from a bracket 94 secured to the photocopier rear panel (not shown in FIG. 3) and the blade is movable between the positions shown in FIG. 3 by dotted and solid line representations of the blade 48. Preferably, the blade is spaced from the drum surface 15 so that its movement will not create wear on the surface.

In a first position of the blade 48, which is shown by the dotted representation in FIG. 3, the blade 48 partially overlays the marginal edge of the photosensitive surface 15 of the drum. With the blade 48 in that position, if a sheet 40 is directed to the drum 14 by the sheet registration rolls 44, a side edge of the sheet 40 will slide along the blade, rather than contact the photosensitive surface 15 of the rotating drum 14. The upper end 48B of the blade has a tang 96 projecting toward the sheet transport assembly 62, particularly to the nip 98 formed between the feedaway roller 50 and the lower knurled wheel 82, so that the leading edge 40A of a sheet 40 sliding along the blade 48 is engaged by the roller 50 and wheel 82 of the assembly.

The upper end 48B of the blade includes a forked portion 99 over which the split end 100 of a laterally movable actuator rod 102 passes. A pin 104 through the split end 100 of the rod passes between the teeth of forked portion 98 of the blade so that lateral movement of the actuator rod 102 will pivot the blade 48 about its pivot screw 92. In the second position of the blade 48, shown by the solid line representation in FIG. 3, the illustrated blade no longer overlays any portion of the photosensitive drum surface 15, so that successive portions of the sheet 40 brought to the drum 14 will contact the photosensitive drum surface 15 fully, from one side edge of the sheet to the other.

FIG. 4 shows the relation between the actuator rod 102 and the other elements of the photocopier apparatus. The Figure also shows the positions of the roller 50, lower and upper knurled wheels 82 and 84, and paper guide shim plate 71 of the sheet transport assembly 62 relative to the pick-off blade 48. It also shows the relative position of a side edge 40D of a sheet of paper 40 in the apparatus.

The actuator rod 102 for pivoting the blade 48 passes through a rear panel 106 of the photocopier and is connected to an actuator pivot 108 pivotally mounted on a pin 109 in a bracket 110 secured to the rear panel 106. The actuator pivot 108 has an arm 112 with a forked end 114 that engages a pin 116 extending through the actuator rod, so that lateral rearward movement of the actuator pivot arm 112 moves the actuator rod 102 rearward (in the direction of the arrow 118). The actuator rod 102 is connected by a spring 120 (see FIGS. 5–7) to the rear panel 106, so that it is constantly biased to move forward.

The actuator pivot 108 is operated by a pin 122 extending down from a slide 124 to engage a gap 125 in a forward extension of the actuator pivot arm 112. The slide 124 is secured to the rear panel 106 by studs 126 passing through horizontal slots 128 in the slide 124, so that the slide can move horizontally. Two brackets mounted on the scanner 24, a slide release bracket 130 and a trigger bracket 132, actuate movement of the slide 124. The different positions of the scanner 24 during operation of the photocopier, and the effect on the slide 124 and the actuator rod 102 can be seen by also referring to FIGS. 5–7.

Figure 5:
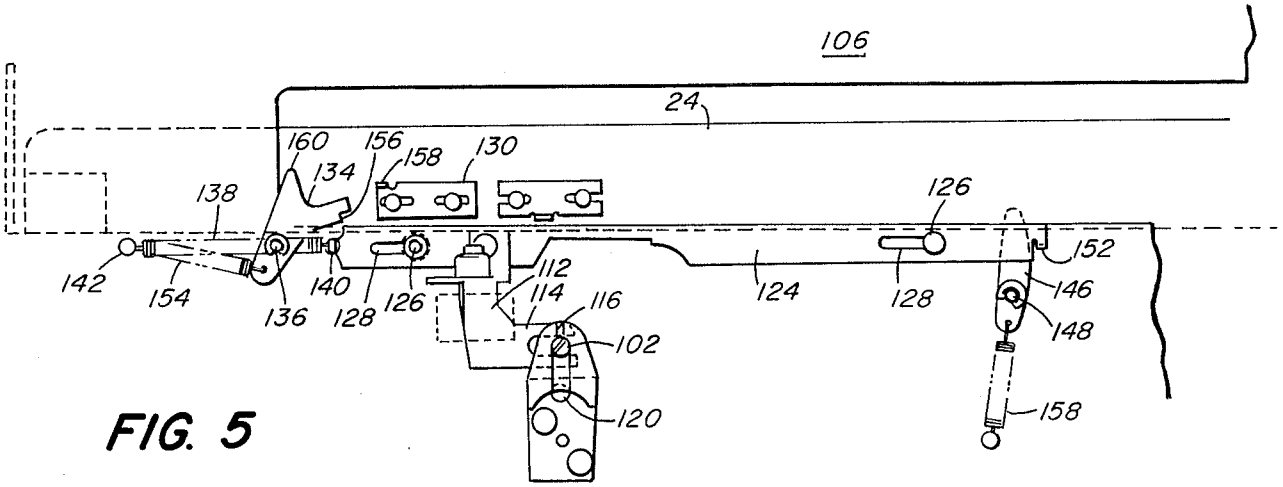
FIG. 5 is an elevation view of the linkage shown in FIG. 4, in a position in which the scanner is at the start of its path of travel.

In the position shown in FIG. 5, the scanner 24 has not yet begun to scan the original, and the scanner brackets 130, 132 are located over the left portion of the slide 124. A slide lock 134, pivotable about a pin 136, is in an unlocked position. The slide 124 is biased to the left by a spring 138 extending from a rearwardly projecting tab 140 at the end of the slide to a fastener 142 secured to rear panel 106. In this position of the slide 124, the actuator pivot arm 112 is not urging the actuator rod pin 116 rearward, and, the actuator rod 102, reacting to the bias exerted by the actuator spring 120, extends forwardly (as shown by the dotted representation in FIG. 4). When the actuator rod 102 is in this position, the pick-off blade 48 is in the position in which it overlays the marginal edge of the drum photosensitive surface 15 (as shown by the dotted line representation in FIGS. 3 and 4).

Figure 6:
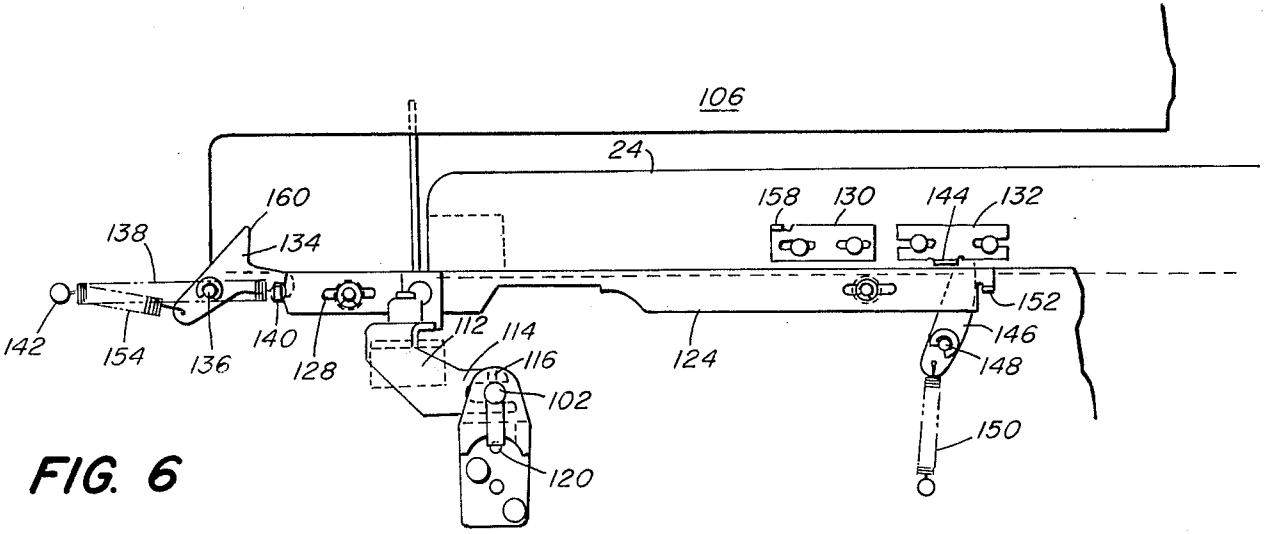
FIG. 6 is a view similar to that of FIG. 5 in which the scanner is at intermediate point in its path of travel.

In a second position of the apparatus, shown in FIG. 6, the scanner 24 has moved to the right, and the trigger bracket 132 is shown in a position in which a tab 144 extending rearwardly from the bottom of the bracket 132 engages a slide positioner 146. The slide positioner 146 is a flat, elongate element that extends between the slide 124 and the rear panel 106. The positioner 146 is pivotally mounted on a pin 148 and biased by a spring 150 to maintain an upright position. When the trigger bracket 132 is moving to the right, as shown in FIG. 6, the trigger bracket tab 144 engages the slide positioner 146 which in turn engages a forwardly extending tab 152 at the right end of the slide 124, moving the slide to the right. When the slide 124 moves to the right, the actuator pivot arm 112 swings rearwardly because of the movement of the slider pin 122, the actuator rod pin 116 is urged rearward by the actuator arm 112, and the rearward movement of the actuator rod 102 moves the pick-off blade 48 to its second position (as shown by the solid line representation of the elements in FIGS. 3 and 4), clear of the drum photosensitive surface. When the slide 124 moves further to the right, the pivotable lock 134 at its left end, biased by a spring 154 to pivot clockwise, does so, and a slide locking surface 156 (FIG. 5) is moved into position against the end of the slide 124, blocking leftward movement of the slide.

Figure 7:
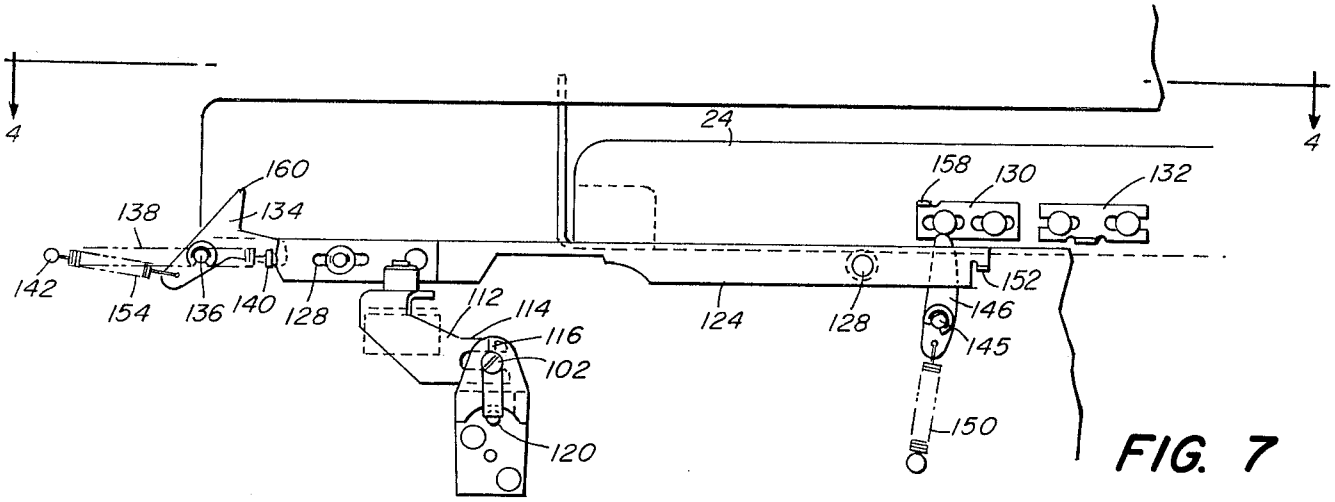
FIG. 7 is a view similar to that of FIG. 6 in which the scanner has gone further in its path of travel.

In a third position of the scanner 24, illustrated in FIG. 7, the scanner 24 has moved further to the right, but no change is effected in the position of the slide 124, which remains locked in place. The scanner 24 can move further and further to the right without effecting any change in the position of slide 124.

When the scanner 24 returns to its original position, a slide release tab 158, extending rearwardly from the slide release bracket 130, engages an upward extension 160 of the slide lock 134, pivoting it counterclockwise to release the slide 124, which then moves leftward in response to the bias force of spring 138. Slide 124 moves leftward until it engages the studs 126 and the entire assembly is restored to the first position, shown in FIG. 5. The pick-off blade 48 is accordingly also restored to its first position (the dotted line representation of FIG. 3).

During operation of the photocopier 12, a sheet 40 is conveyed to the drum photosensitive surface 15 after the scanner 24 has begun to scan the original. As the first portion of the developed image on the drum surface 15 approaches the transfer station 42 the leading portion 40A of the transfer sheet 40 is brought to the drum surface 15 by the registration rollers 44. At this time the pick-off blade 48 is in its first position, as shown by the dotted line representation in FIG. 3. As the leading portion 40A of the transfer sheet comes into contact with the drum surface 15, the side edge 40D slides along the pick-off blade 48. The leading edge corner of the sheet 40 is brought by the tang 96 of the pick-off blade 48 into engagement with the nip 98 of the roller 50 and lower knurled wheel 82 of the sheet transport assembly 62. The alignment of the brackets 130, 132 on the scanner 24 is selected so that after this engagement of the paper, the slide 124 is brought to the position shown in FIG. 6, and the pick-off blade 48 is pivoted away from its first position to its second position, clear of the drum photosensitive surface 15. The blade remains in this second position at least until after the sheet 40 has left contact with the drum surface 15 and the transfer process is completed. The return of the scanner 24 to its original position restores the blade 48 to its position, overlaying the drum surface 15.

Thus it can be seen that successive portions of the transfer sheet after the leading portion 40A, contact the photosensitive drum surface 15 completely, from one side edge of the sheet to the other. At the conclusion of the transfer process the scanner 24 returns to its original position and returns the pick-off blade 48 to its original position. Thus, the pick-off blade 48 overlays the photosensitive surface 15 for a period only long enough to allow the leading corner of the transfer sheet 40 to be engaged by the sheet transport assembly 62. As soon as that goal is accomplished, the pick-off blade 48 is moved away from its overlying position and the transfer sheet 40 can contact the drum surface fully. Thus only a corner of the transfer sheet 40 is not available for copying purposes.

Figure 10:
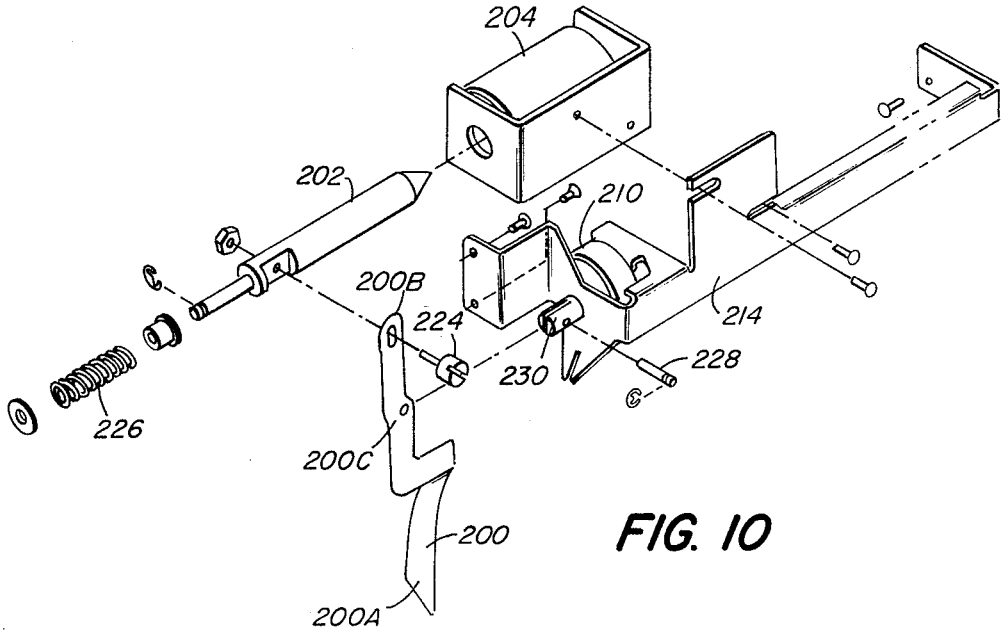
FIG. 10 is an exploded view of the blade assembly of the apparatus shown in FIGS. 8 and 9.
Figure 8:
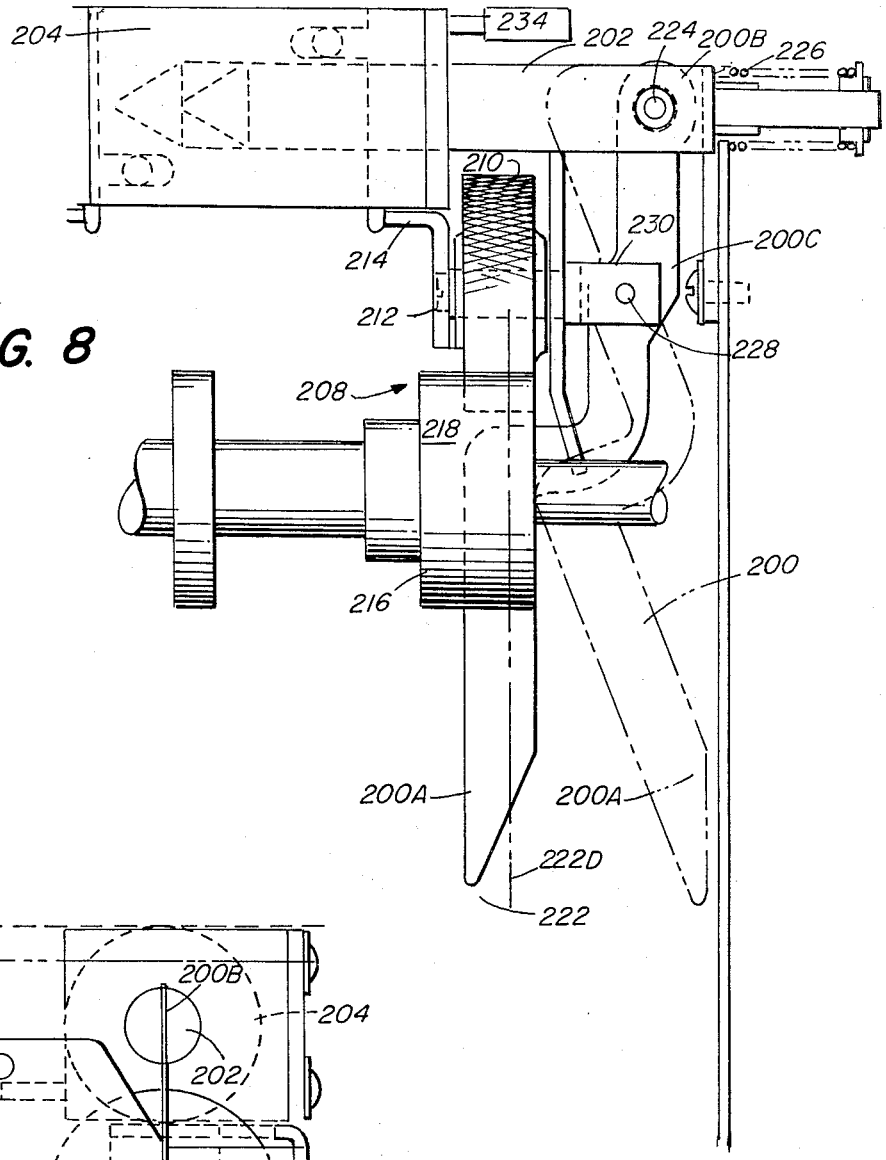
FIG. 8 is a side elevation of a drum and sheet stripping apparatus according to a second embodiment of the invention.
Figure 9:
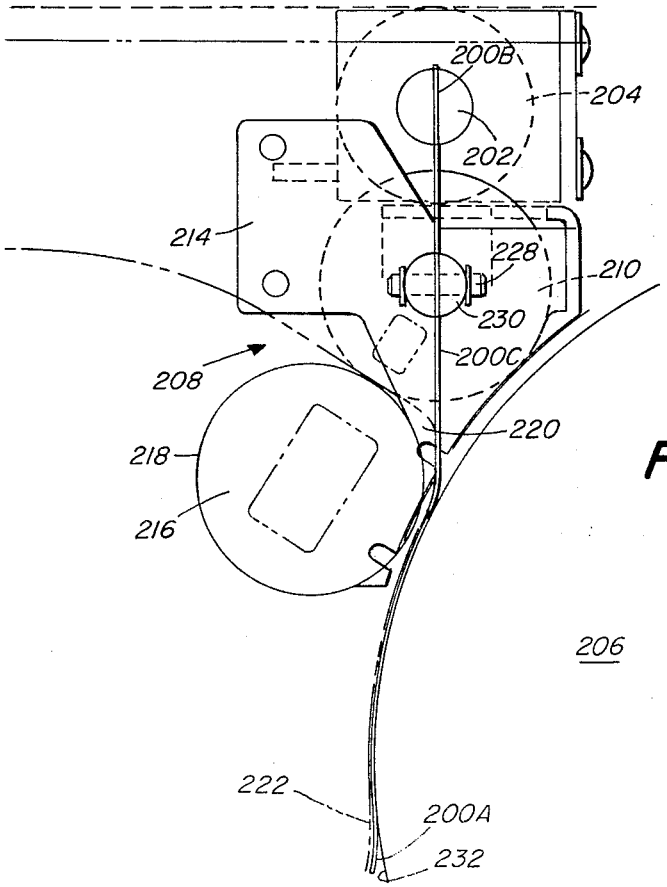
FIG. 9 is a front elevation of the apparatus shown in FIG. 8.

A second embodiment of the invention is shown in FIGS. 8, 9 and 10. In the second embodiment, a pick-off blade 200 has a pivot point not at the end of the blade but at an intermediate point, and an actuating rod 202 is not controlled by a mechanical linkage to the scanner, but by a solenoid 204 actuated by electrical switch timing corresponding substantially to the scanner position.

Referring to FIGS. 8–10, there is shown a drum 206, the pick-off blade 200, and a sheet transport assembly 208. The sheet transport assembly includes a knurled wheel 210, rotatable about a shaft 212 supported in a housing 214, and a roller 216 with a rubber surface layer 218. The knurled wheel 210 and the roller 216 form a nip 220 for engaging sheets 222 directed to the sheet transport assembly 208 by the blade 200.

The blade 200 has a lower portion 200A curved to follow the curvature of the drum 206. The upper end 200B of the blade is rotatably connected by a screw 224 to an actuator rod 202. The actuator rod 202 is slidable in, and operable by, a solenoid 204 in a well-known manner; that is, in response to energization of the solenoid, the actuator rod 202 will be pulled into the solenoid 204 against the resistance of a bias spring 226. The spring 226 keeps the actuator rod, when the solenoid is not energized, extended out of the solenoid.

The blade pivots, at intermediate portion 200C of the blade 200, between the bottom portion 200A and the upper end 200B, about a pin 228 fixedly secured to the photocopier assembly, in the illustrated embodiment, to the extension 230 of the knurled wheel shaft 212. The blade 200 and transport assembly 208 are arranged so that when the solenoid 204 is not energized, actuator rod 202 extends away from the solenoid, and the bottom portion 200A of the blade overlays the photosensitive surface 232 of the drum 206 (though not contacting the drum surface) in a first position shown by the solid line representation in FIG. 8. In that position, the side edge 222D of the leading portion of a sheet conveyed to the drum photosensitive surface 232 will slide along the blade 200 and be directed to the nip 220 of the sheet transport assembly 208 for engagement of the sheet by the assembly.

The solenoid 204 is energized by a switch 234 shown diagrammatically in FIG. 8. Switch 234 can be operated by movement of the photocopier scanner, or by corresponding timing mechanisms such as those that control the actuation of other elements of the photocopier apparatus. The energization of solenoid 204 is preferably timed to occur after a leading corner portion of the transfer sheet 222 is securely engaged by the transport assembly. When the solenoid is energized, the actuator rod 202 is pulled into the solenoid 204, pivoting the blade 200 about the pivot pin 228, and moving the blade bottom portion 200A to a second position, shown by the dotted line representation in FIG. 8, in which it does not overlay the drum photosensitive surface 232. Successive portions of the transfer sheet 222 brought to the drum surface 232 can then contact the surface from side edge to side edge. The reciprocal operation of the blade 200 in the second embodiment is like that of the blade 48 in the first. The blade thus overlays the marginal edge of the drum photosensitive surface long enough to allow the leading edge of the transfer sheet to be securely engaged by the transport assembly, and then the blade is moved away from the drum surface.

ADVANTAGES OF THE INVENTION AND NON-OBVIOUSNESS

The sheet stripping apparatus described herein provides a secure method and structure for stripping the transfer sheet from a transfer station without interfering with the transfer function. After the side edge of the leading portion of a transfer sheet is brought by the blade to be engaged by the sheet transport assembly, the blade is moved away, so that successive portions of the sheet may engage the photosensitive drum across their full width. Therefore the invention has the advantage of allowing, for the first time in a photocopier employing liquid development, full width copying onto the transfer sheet. The reciprocating pick-off blade constructed according to the invention is also preferably designed to avoid contact with the drum surface, thereby avoiding wear or interference with the operation of the drum.

Pick-off blades of earlier liquid development photocopiers contact the drum surface firmly, and overlay the drum surface as little as possible. They are kept as narrow as possible in terms of overlying the drum surface in order to reduce the area of the transfer sheet which is unavailable for copying. Since the pick-off blade of the invention will be moved away from the drum shortly after the leading edge of the transfer sheet reaches the transfer station, and will therefore interfere with full width copying for only a portion of the sheet, it may overlay a greater marginal width of the drum photosensitive surface to insure that the side edge of the sheet is "captured".

Alternative forms of the invention may be constructed in accordance with the description given and the illustrative embodiments set forth. The particular shape of the pick-off blade, for example, may be varied depending on the transport assembly used to transport sheets away from the transfer station. Different means for moving the blade from its overlying position on the drum surface are possible. Other alternative modifications, deletions, or additions will be obvious to those skilled in the art and are within the scope of the following claims:

We claim:

1. In a copying apparatus having:

a rotating drum having a reusable photosensitive surface, means for scanning an original to produce a latent electrostatic image on said surface, means for developing said latent image, and a transfer station for transferring said developed image onto a transfer material, said transfer station having:

means for conveying a sheet of transfer material into contact with said photosensitive surface at said transfer station for transferring said developed image from said surface to said sheet, portions of said sheet successively contacting said surface, means for stripping said sheet from said surface, and means for transporting said stripped sheet from said transfer station, a sheet stripping apparatus comprising:

a guide member having a sheet contacting portion, means for moving said guide member between a first position interposed between said drum surface and said sheet being conveyed to said surface in which said sheet contacting portion overlays a marginal portion of said surface at said transfer station for engaging a corner of a leading edge of said sheet conveyed to said transfer station, preventing said corner from contacting said photosensitive surface, and guiding said leading edge to said transport means, and a second position in which said sheet contacting portion is removed from its overlaying position with respect to said surface whereby said sheet can, at said transfer station, contact said surface at said marginal portion, and said moving means including means for moving said member at least in a direction parallel to said photosensitive surface from said first to said second position while said sheet is being conveyed to said transfer station.

2. The sheet stripping apparatus of claim 1 wherein said guide member further comprises a directing portion for directing said sheet edge to said transporting means.

3. The sheet stripping apparatus of claim 2 further comprising means for activating said moving means to move said guide member from said first to said second position at a time after said transporting means has engaged at least a leading corner of said sheet and for activating said moving means to return said guide member from said second to said first position at a time after the trailing edge of said sheet is no longer in contact with said drum surface.

4. The sheet stripping apparatus of claim 3 wherein said activating means includes said scanning means.

5. The sheet stripping apparatus of claim 1 wherein said moving means comprises means for maintaining said guide member out of contact with said drum photosensitive surface.

6. In a copying apparatus having:

a rotating drum having a reusable photosensitive surface, means for scanning an original to produce a latent electrostatic image on said surface, means for developing said latent image, and a transfer station for transferring said developed image onto a transfer material, said transfer station having:

means for conveying a sheet of transfer material into contact with said photosensitive surface at said transfer station for transferring said developed image from said surface to said sheet, portions of said sheet successively contacting said surface, means for stripping said sheet from said surface, and means for transporting said stripped sheet from said transfer station, a sheet stripping apparatus comprising:

a guide member having a blade curved to substantially conform to said drum surface, movable between a first position in which said sheet contacting portion overlays a marginal portion of said surface at said transfer station for engaging a corner of a leading edge of said sheet conveyed to said transfer station and guiding said leading edge to said transport means, and a second position in which said sheet contacting portion is removed from its overlaying position with respect to said surface whereby said sheet can, at said transfer station, contact said surface at said marginal portion, said guide member having first and second end portions, said first end portion being pivotally mounted in said copying apparatus, and moving means mechanically responsive to movement of said scanner comprising means connected to said guide member second end portion for reciprocally moving said guide member in a direction substantially parallel to said photosensitive surface from said first to said second position at a time after said transporting means has engaged said sheet and means for moving said guide member from said second position to said first position at a time after the trailing edge of said sheet is no longer in contact with said drum surface, said moving means further comprising means for maintaining said guide member out of contact with said drum photosensitive surface.

7. In a copying apparatus having:

a rotating drum having a reusable photosensitive surface, means for scanning an original to produce a latent electrostatic image on said surface, means for developing said latent image, and a transfer station for transferring said developed image onto a transfer material, said transfer station having:

means for conveying a sheet of transfer material into contact with said photosensitive surface at said transfer station for transferring said developed image from said surface to said sheet, portions of said sheet successively contacting said surface, means for stripping said sheet from said surface and means for transporting said stripped sheet from said transfer station, a sheet stripping apparatus comprising:

a guide member having a sheet contacting blade curved to substantially conform to said drum surface, movable between a first position in which said sheet contacting portion overlays a marginal portion of said surface at said transfer station for engaging a corner of a leading edge of said sheet conveyed to said transfer station and guiding said leading edge to said transport means, and a second position in which said sheet contacting blade is removed from its overlaying position with respect to said surface whereby said sheet can, at said transfer station, contact said surface at said marginal portion, and means for moving said member between said first and second positions, said guide member having first and second end portions, one of said end portions being pivotally mounted in said copying apparatus and the other of said end portions being connected to said moving means.

8. In a copying apparatus having:

a rotating drum having a reusable photosensitive surface, means for scanning an original to produce a latent electrostatic image on said surface, means for developing said latent image, and a transfer station for transferring said developed image onto a transfer material, said transfer station having:

means for conveying a sheet of transfer material into contact with said photosensitive surface at said transfer station for transferring said developed image from said surface to said sheet, portions of said sheet successively contacting said surface, means for stripping said sheet from said surface, and means for transporting sid stripped sheet from said transfer station, a sheet stripping apparatus comprising:

a guide member having a sheet contacting portion, movable between a first position in which said sheet contacting portion overlays a marginal portion of said surface at said transfer station for engaging a corner of a leading edge of said sheet conveyed to said transfer station and guiding said leading edge to said transport means, and a second position in which said sheet contacting portion is removed from its overlaying position with respect to said surface whereby ssaid sheet can, at said transfer station, contact said surface at said marginal portion, and means for moving said member between said first and second positions, comprising means mechanically responsive to movement of said scanner, said mechanical means comprising means for moving said guide member from said first to said second position at a time after said transporting means has engaged said sheet and means for moving said guide member from said second position to said first position at a time after the trailing edge of said sheet is no longer in contact with said drum surface.

9. In a copying apparatus having:

a rotating drum having a reusable photosensitive surface, means for scanning an original to produce a latent electrostatic image on said surface, means for developing said latent image, and a transfer station for transferring said developed image onto a transfer material, said transfer station having:

means for conveying a sheet of transfer material into contact with said photosensitive surface at said transfer station for transferring said developed image from said surface to said sheet, portions of said sheet successively contacting said surface, means for stripping said sheet from said surface, and means for transporting said stripped sheet from said transfer station, a sheet stripping apparatus comprising:

a guide member having a sheet contacting portion, means for moving said guide member between a first position interposed between said drum surface and said sheet being conveyed to said surface in which said sheet contacting portion overlays a marginal portion of said surface at said transfer station for engaging a corner of a leading edge of said sheet conveyed to said transfer station preventing said corner from contacting said photosensitive surface, and guiding said leading edge to said transport means, and a second position in which said sheet contacting portion is removed from its overlaying position with respect to said surface whereby said sheet can, at said transfer station, contact said surface at said marginal portion, and said moving means including solenoid controlled means for moving said member between said first and second positions, and switching means for energizing said solenoid means to move said guide member at least in a direction parallel to said photosensitive surface from said first to said second position at a time after said transporting means has engaged at least a leading corner of said sheet and to move said guide member from said second position to said first position at a time after a trailing edge of said sheet is no longer in contact with said drum surface.

10. The sheet stripping apparatus of claim 9 wherein said mechanical means includes means for reciprocally moving said guide member in a direction substantially parallel to said photosensitive surface.

11. The sheet stripping apparatus of claim 10 wherein said guide member has a first end portion and a second end portion, said first end portion being pivotally mounted in said copying apparatus, and said second end portion being connected to said reciprocating means.

12. In a copying apparatus having:

a rotating drum having a reusable photosensitive surface, means for scanning an original to produce a latent electrostatic image on said surface, means for developing siad latent image, and a transfer station for transferring said developed image onto a transfer material, said transfer station having:

means for conveying a sheet of transfer material into contact with said potosensitive surface at said transfer station for transferring said developed image from said surface to said sheet, portions of said sheet successively contacting said surface, means for stripping said sheet from said surface, and means for transpórting said stripped sheet from said transfer station, a sheet stripping apparatus comprising:

a guide member having a sheet contacting portion, movable between a first position in which said sheet contacting portion overlays a marginal portion of said surface at said transfer station for engaging a corner of a leading edge of said sheet conveyed to said transfer station and guiding said leading edge to said transport means, and a second position in which said sheet contacting portion is removed from its overlaying position with respect to said surface whereby said sheet can, at said transfer station, contact said surface at said marginal portion, and means for moving said member between said first and second positions, comprising:

first and second fixed actuating elements carried by said moving scanner means, a slider element movable from an inoperative position corresponding to one of said guide member first and second positions to an operative position corresponding to said guide member other position, means for locking said slider member in said operative position, mechanical linking means actuated in response to movement of said slider means for moving said guide member between said first and said second positions, means responsive to one of said fixed actuating elements carried by said scanner for moving said slider element to said operative position, and means responsive to said other of said fixed actuating elements carried by said scanner for releasing said slider from said operative position, said other element being operable to release said locking means whereby said slider returns to said inoperative position.

13. The sheet stripping apparatus of claim 12 wherein said mechanical linking means comprises a first pivoting member responsive to movement of said slider element for pivoting from a third position when said slider element is in said inoperative position to a fourth position when said slider element is in said operative position, a reciprocal actuating member for movement parallel to a rotating axis of said drum in response to the pivoting movement of said pivoting means, said reciprocal member having secured at one end thereof said guide member for movement of said guide member between said first and said second positions.

14. In a copying apparatus having:

a rotating drum having a reusable photosensitive surface, means for scanning an original to produce a latent electrostatic image on said surface, means for developing said latent image, and a transfer station for transferring said developed image onto a transfer material, said transfer station having:

means for conveying a sheet of transfer material into contact with said photosensitive surface at said transfer station for transferring said developed image from said surface to said sheet, portions of said sheet successively contacting said surface, means for stripping said sheet from said surface, and means for transporting said stripped sheet from said transfer station, comprising a knurled roller in spaced apart alignment with a friction surface roller for engaging said transfer sheet, said knurled roller being disposed for contacting the image bearing side of said transfer sheet, a sheet stripping apparatus comprising:

a guide member having a sheet contacting portion, movable between a first position in which said sheet contacting portion overlays a marginal portion of said surface at said transfer station for engaging a corner of a leading edge of said sheet conveyed to said transfer station and guiding said leading edge to said transport means, and a second position in which said sheet contacting portion is removed from its overlaying position with respect to said surface whereby said sheet can, at said transfer station, contact said surface at said marginal portion, and means for moving said member between said first and second positions.

* * * * *